US006550624B1

(12) United States Patent
Irsh et al.

(10) Patent No.: US 6,550,624 B1
(45) Date of Patent: Apr. 22, 2003

(54) TELESCOPIC CRANE

(75) Inventors: Michael Irsh, Lebach; Walter Stowasser, Zweibrücken; Frank Conrad, Hornbach; Oliver Fries, Schiffweiler; Jens Fery, Ensdorf; Roland Kuhn; Walter Zimmer, both of St. Ingbert; Markus Marx, Schwalbach, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/605,403

(22) Filed: Jun. 28, 2000

(30) Foreign Application Priority Data

Jun. 28, 1999 (DE) ..... 199 30 537

(51) Int. Cl.[7] ..... B66C 23/04

(52) U.S. Cl. ..... 212/299; 52/118; 212/231; 212/348

(58) Field of Search ..... 52/118; 212/348, 212/230, 231, 264

(56) References Cited

U.S. PATENT DOCUMENTS

| | | | | |
|---|---|---|---|---|
| 220,031 | A | 9/1879 | Meyer et al. | |
| 3,638,806 | A | 2/1972 | Hippach | 212/55 |
| 4,106,631 | A | 8/1978 | Lundy | 212/144 |
| 4,512,482 | A | 4/1985 | Mentzer | 212/188 |
| 4,967,917 | A | 11/1990 | Loizumi et al. | 212/188 |
| 5,281,078 | A | 1/1994 | Mills | 212/180 |
| 6,062,793 | A | 5/2000 | Isley | 414/23 |

FOREIGN PATENT DOCUMENTS

| | | |
|---|---|---|
| DE | 31 13 763 C2 | 10/1982 |
| DE | 3810408 A1 | 10/1989 |
| DE | 3838975 C2 | 2/1991 |
| GB | 2096097 | 10/1982 |

OTHER PUBLICATIONS

Brochure issued by Mannesmann Demag Fördertechnik, Demag AC 1600, Apr. 1996, pp. 5, 17 and 27.

DE–Z Deutsche Hebe– und Fördertechnik Grösster Derrick– Kran der BRD hilft beim Reaktorbau, 1972, pp. 876–680.

*Primary Examiner*—Thomas J. Brahan
(74) *Attorney, Agent, or Firm*—Henry M. Feiereisen

(57) ABSTRACT

A telescopic crane, includes a substructure, a superstructure rotatably mounted onto the substructure, a counterweight and a telescoping boom structure which includes a main boom slewable about a luffing plane. The main boom has a boom base and at least one telescope section received in the boom base and displaceable between retracted and extended positions. At least one guy support is mounted to the boom structure and connected to a guy rope which extends substantially longitudinally in the direction of the boom structure. The guy support is oriented with respect to the luffing plane at an inclination which is so selected that a lateral load acting on the boom structure is partially or entirely received by the guying.

30 Claims, 8 Drawing Sheets

TELESCOPIC CRANE

CROSS-REFERENCES TO RELATED APPLICATIONS

This application claims the priority of German Patent Application, Ser. No. 199 305 37.4, filed Jun. 28, 1999, the subject matter of which is incorporated herein by reference.

BACKGROUND OF THE INVENTION

The present invention relates to a telescopic crane of a type having a substructure, a revolving superstructure mounted to the substructure, a counterweight and a boom structure comprised of a main boom having a boom base and at least one telescope section which is received in the boom base and displaceable between retracted and extended positions.

In extended position, telescopic cranes are exposed to varying degrees of stress depending on the angular disposition. Oftentimes, the lateral deformation of the main boom in steep-incline disposition is the criterion that limits the load-carrying capability. When the angular disposition is flat or average, the loads applied in the mounting of the extended telescope sections represent a crucial criterion for the maximum load-carrying capability. In the latter case, the so-called super lift operation has been developed for torque relief.

The use of telescopic cranes with super lift operation has been known for a long time. An example is illustrated in a brochure issued by Mannesmann Demag Fordertechnik, Demag AX 1600, April 1996, pages 5, 17 and 27. A guy truss is arranged on the boom base of the main boom for placement on the boom base to increase the load-carrying capability and to reduce sag of the main boom. The guy truss is connected, on the one hand, to the foot region of the main boom via a guy rope of substantially constant length, and, on the other hand, to the head or collar of one of the inner telescope sections via a further guy rope of normally variable length. This reinforcing configuration is applicable for the base unit alone, or in conjunction with the arrangement of a fly jib in the form of a latticed tower which can be of the fixed type or luffing type. Telescopic cranes of this kind suffer shortcomings because the boom structure deforms laterally, especially in steep-incline disposition.

SUMMARY OF THE INVENTION

It is thus an object of the present invention to provide an improved telescopic crane, obviating the afore-stated drawbacks.

In particular, it is an object of the present invention to provide an improved telescopic crane whose lateral deformation of the boom structure is significantly reduced, in particular in steep-incline disposition, compared to conventional telescopic cranes.

These objects, and others which will become apparent hereinafter, are attained in accordance with the present invention by providing at least one guy support which is mounted to the boom structure and connected to a tension means extending substantially longitudinally in the direction of the boom structure, with the guy support oriented with respect to the luffing plane at an inclination which is so selected that a lateral load acting on the boom structure is partially or entirely received by the guying.

The inclination of the guy support can be realized transversely to the longitudinal direction or in longitudinal direction or in superimposed transversely to and longitudinally in direction of the boom structure.

According to another feature of the present invention, two inclined guy supports can be provided on the topside of the respective boom element of the boom structure, whereby the angular disposition of both guy supports is normally identical. Of course, the angular disposition of both guy supports may also differ depending on the direction of the forces acting on the boom structure. The foot ends of both guy supports may be connected to the topside of the boom structure at a common area, or may be offset to one another. It is also conceivable to connect the foot end of at least one of the guy supports with the boom structure in the transition zone between topside and respective sidewall. As an alternative, there is also the option to arrange the foot end of at least one of the guy supports upon a girder which extends transversely to the longitudinal axis of the boom structure and projects beyond the boom structure.

Through the provision of a guy support according to the present invention, the portion of the guying force, effective in lateral direction, can be gradually and continuously modified in dependence on the angular disposition of the guy support. In the event, two guy supports are arranged offset to one another, both parallel guy supports act as super lift operation in a same manner as the conventional guy truss, when the boom structure is in the one extreme disposition, i.e. vertical disposition. At an angular position of <90° to >0° for both guy supports, the effective tautening force is split into a component super lift operation and a component lateral guying. In the other extreme position, i.e. horizontal disposition, both guy supports realize a reinforcement in both lateral directions.

The free head end of each guy support can be selectively connected via a first tension member with the substructure, the superstructure, the foot region of the boom structure, the fixed or separately guided counterweight, or the bottom in the direction of the boom structure, and via a further tension member with a selected area of the boom structure in the direction of its head. The respectively desired angular disposition of the guy supports may be adjusted step-by-step or continuously by swinging the guy supports, so that an asymmetric angular disposition is also possible. Thus, when a lateral force is applied on one side, the respective guy support is inclined progressively in the direction of lateral guying whereas the other guy support remains in a central disposition.

As the distance of the tension members from the boom structure has also an impact on the desired reinforcement, it is proposed to change the length of the guy supports in steps or continuously. The tension members may be a guy rope or a guy rod, and may be arranged with or without prestress. When prestressed at a degree that can be re-adjusted, the tension means is operatively connected with a tensioning mechanism. Suitably, the tensioning mechanism is a winch or a piston and cylinder unit. However, it is also possible, to exploit the angular disposition and/or change in length of the guy supports as tensioning mechanism. The tensioning mechanism may be selectively mounted to the guy supports, to the boom structure, to the superstructure or substructure, or to the counterweight.

According to another feature of the present invention, the guy supports are mounted to the main boom in the area of the boom base, in particular in the forward region between the hinged attachment of the luffing cylinder and the forward bearing on the boom base. Each guy support is suitably connected to a piston and cylinder unit which is mounted to the boom base, for continuous adjustment of the guy supports.

According to another feature of the present invention, the guy support includes two poles between which the winch may be positioned.

A telescopic crane according to the present invention may be further complemented by a fixed or luffing fly jib in the form of a latticed mast. Guy supports in accordance of the present invention may also be mounted to this type of jib.

A lateral guying is especially effective when the crane is provided with a measuring device, e.g. a load cell, for detecting a lateral deformation of the boom structure. When the deformation exceeds a predetermined admissible value, the tension member connected to the guying is activated for tautening the guying. The extent of lateral deformation can be registered directly or indirectly via crane parameters, for example, the rope tension, the rope length and the rope extension. However, forces acting upon the boom structure may be used for determination the degree of lateral deformation, such as side winds, exposure to sunlight and temperature of the boom structure.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1A:
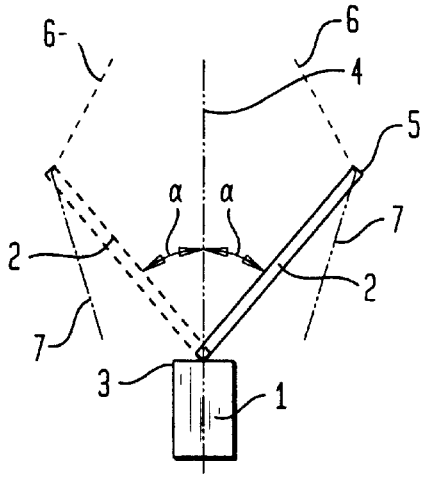
FIG. 1*a* is a principal illustration of a first embodiment of a telescopic crane according to the present invention, illustrating the arrangement of a guy support which is inclined with respect to the luffing plane.

Throughout all the Figures, same or corresponding elements are generally indicated by same reference numerals.

Turning now to the drawing, and in particular to FIG. 1*a*, there is shown a principal illustration of a first embodiment of a telescopic crane according to the present invention, illustrating the arrangement of a mast-like guy support 2 which is inclined with respect to the luffing plane. The guy support 2 is mounted, preferably, onto the topside of an exemplified boom element 1 of a boom structure (not shown). The boom element 1 is shown here only symbolically by way of a box for sake of simplicity and may represent a boom base or a telescope section of a main boom of the telescopic crane or the latticed tower of a fixed or luffing fly jib. The boom element 1 is defined by a center axis 4 which, ideally, is also the luffing plane of the boom structure.

In accordance with the present invention, the guy support 2 is inclined with respect to the luffing plane at an angle of $\alpha>0$. As shown by broken lines, the guy support 2 may also be inclined to the other side. The guy support 2 has a free end 5 which is guyed by means of tension members 6, 7, preferably guy ropes. Although not shown in detail, the tension members 6, 7 are connected at a fixed point on the boom structure, or a tensioning mechanism such as a piston and cylinder unit, or a winch. Tautening of the tension members 6, 7 may, however, also be realized without use of a tensioning mechanism by arranging the tension members 6, 7 at a smaller or greater angle $\alpha$ and then further inclining the guy support 2. As an alternative, it is also possible to make the guy support 2 of telescopic configuration to effectuate a tautening through change in length.

Figure 1B:
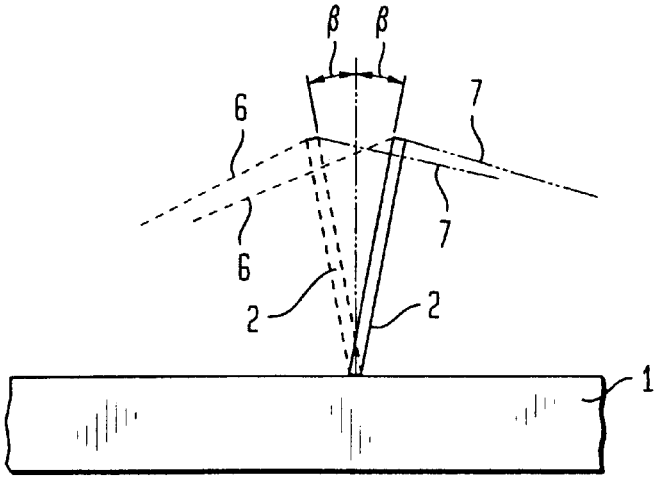
FIG. 1*b* is a 90° rotated disposition thereof.
Figure 1C:
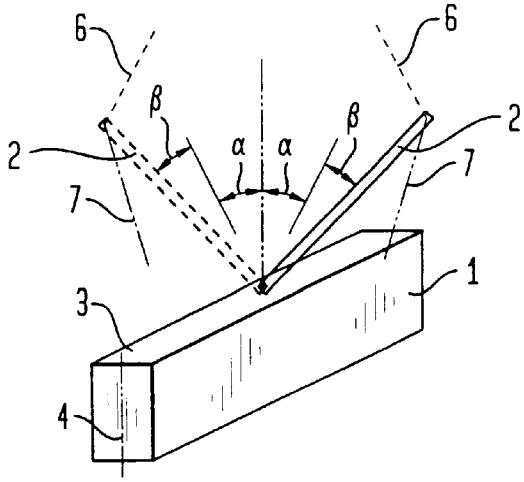
FIG. 1*c* is a perspective illustration thereof.

As shown in FIG. 1*b*, which is an illustration in 90° rotated disposition, the guy support 2 may also be inclined in another plane at an angle $\beta>0$. FIG. 1*c* shows the option to superimpose the inclination of the guy support 2 in both planes.

Figure 2:
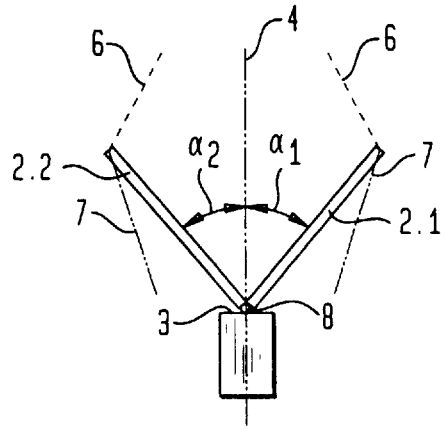
FIG. 2 is a principal illustration of a second embodiment of a telescopic crane according to the present invention, illustrating the arrangement of two inclined guy supports converging at a common foot end.

Turning now to FIG. 2, there is shown a principal illustration of a second embodiment of a telescopic crane according to the present invention, illustrating the arrangement of two inclined guy supports 2.1, 2.2 which converge to a single common foot end 8 swivel-hinged at the topside 3 of the boom element 1. The angle of inclination $\alpha 1$ of the guy support 2.1 with respect to the luffing plane 4 and the angle of inclination $\alpha 2$ of the guy support 2.2 with respect to the luffing plane 4 may be identical or different.

Figure 3A:
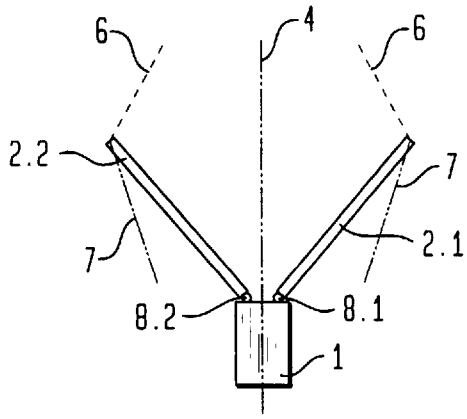
FIGS. 3*a* to 3*d* are principal illustrations of a third embodiment of a telescopic crane according to the present invention, illustrating variations of an arrangement of two inclined guy supports terminating in separate foot ends.
Figure 3B:
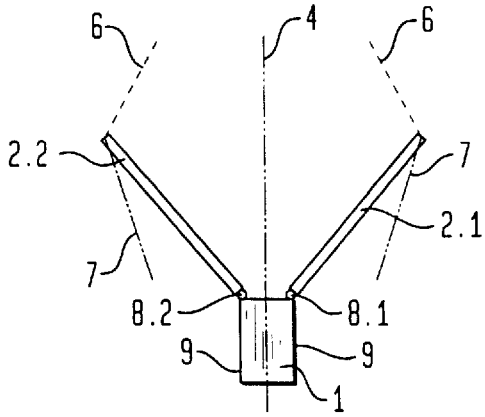
Figure 3C:
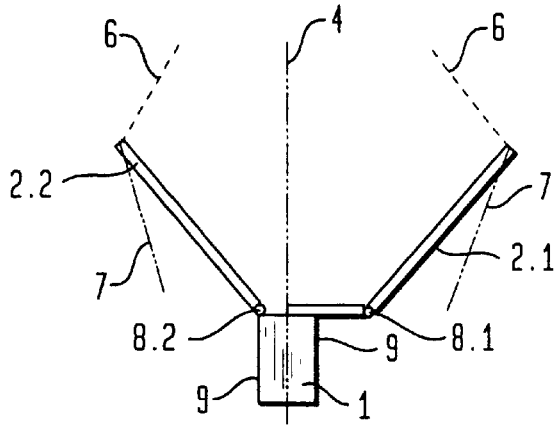
Figure 3D:
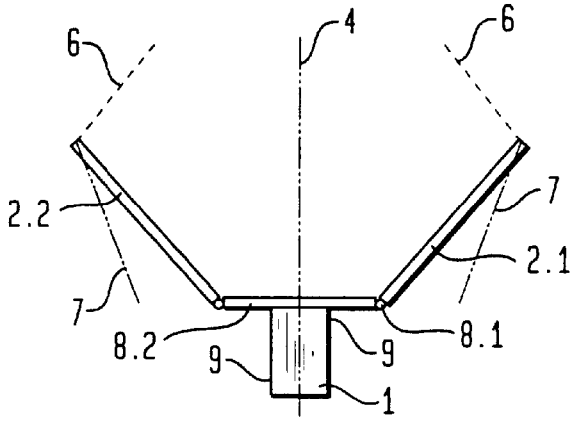

FIGS. 3*a* to 3*d* show principal illustrations of a third embodiment of a telescopic crane according to the present invention, illustrating variations of an arrangement of two inclined guy supports 2.1, 2.2 terminating in separate foot ends 8.1, 8.2, respectively. In FIG. 3*a*, the foot ends 8.1, 8.2 terminate on the topside 3 of the boom element 1 whereas in FIG. 3*b* the foot ends 8.1, 8.2 terminate in the transition zone from the topside 3 to the respective sidewall 9. FIG. 3*c* depicts the option to arrange at least one of the foot ends, here foot end 8.1, outside of the boom element 1. In this case, a girder 10 is secured onto the topside 3 and projects out to the right of FIG. 3*c*, with the foot end 8.1 of the guy support 2.1 swivel-hinged to the end of the girder 10. FIG. 3*d* shows the option to place onto the topside 3 of the boom element 1 a girder 11 which projects out from both sides of the boom element 1 so that both foot ends 8.1, 8.2 of both guy supports 2.1, 2.2 are positioned outside the boom element 1.

Figure 4:
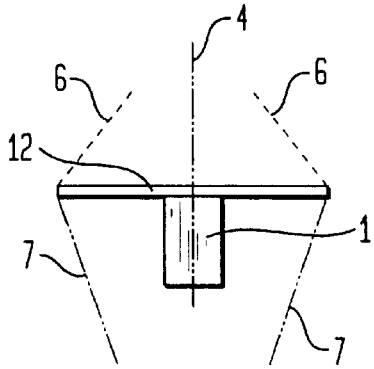
FIG. 4 is a principal illustration of a fourth embodiment of a telescopic crane according to the present invention, illustrating the arrangement of a guy support in traverse disposition.

A special case is illustrated in FIG. 4 which depicts the provision of a guy support in the form of a girder 12 extending across the topside 3 of the boom element 1 beyond the boom element 1. This special case can be realized by positioning the guy supports 2.1, 2.2 of FIG. 2 at angles of inclinations $\alpha 1$ and $\alpha 2$ of 90°.

Figure 5B:
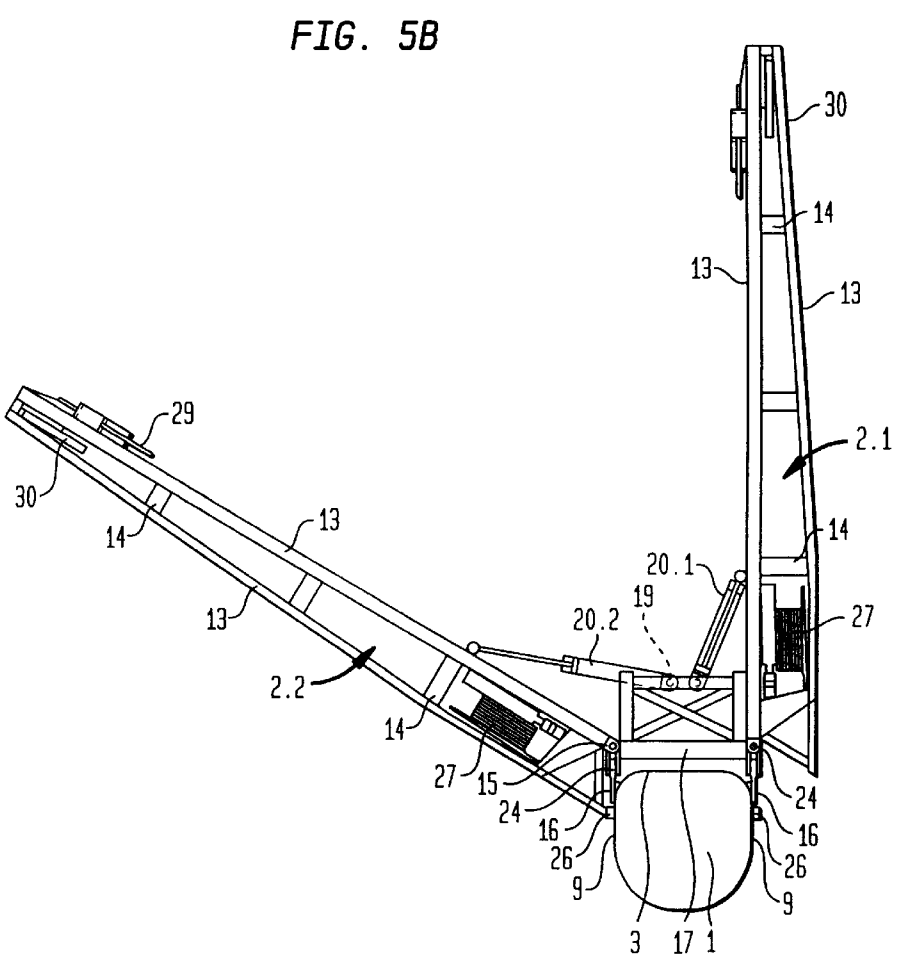
FIG. 5*b* is a side view thereof.
Figure 5A:
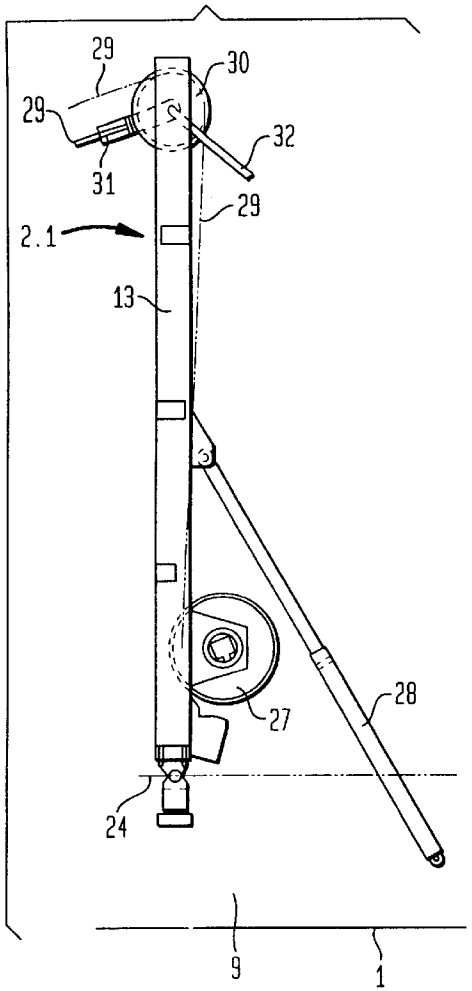
FIG. 5*a* is a front view of an exemplified telescopic crane embodying the principles of the present invention with two inclined guy supports.

Referring now to FIGS. 5*a* and 5*b*, there are shown a front view and a side view, respectively, of an exemplified telescopic crane embodying the principles of the present invention with two inclined guy supports 2.1, 2.2. In this nonlimiting example, the boom element 1 is represented by a boom base of a main boom of the telescopic crane. Swingably mounted to the topside 3 of the boom base 1 is a superstructure 15 which is connected to the boom base 1 via brackets 16. The superstructure 15 includes an upper girder 19 and a lower girder 17 which has opposite ends for respective attachment of the guy supports 2.1, 2.2 which are tiltable to the side. The guy support 2.1 is tilted continuously by a piston and cylinder unit 20.1 which has one end hinged to the guy support 2.1 and another end hinged to the upper girder 19 of the superstructure 3. Likewise, the guy support 2.2 is tilted continuously by a piston and cylinder unit 20.2 which has one end hinged to the guy support 2.2 and another end hinged to the upper girder 19 of the superstructure 15. The example shown in FIGS. 5*a*, 5*b* illustrates the case in which the right-hand guy support 2.1 is in a vertical disposition, comparably to a guy truss, while the left-hand guy support 2.2 occupies the greatest slewable disposition.

As the guy supports 2.1, 2.2 are of an identical construction, the following description refers only to the guy support 2.1. However, it will be understood by persons skilled in the art that a description of one of the guy supports 2.1, 2.2 is equally applicable to the other one of the guy supports 2.1, 2.2. The guy support 2.1 includes two poles 13 which extend substantially parallel in the lower section and slightly converge in the area of the upper section. Interconnection of both poles 13 is realized by crossbars 14. The inner one of the poles 18 is provided at its foot end with a hinge 24. The outer one of the poles 13 bears upon the upper portion of the sidewall 9 of the boom base 1 when the guy supports 2.1 occupies their greatest inclination. This respective point of attack on the sidewall 9 is suitable reinforced by sheet metal 26. A winch 27 is rigidly positioned between the poles 13 in the lower area of the guy support 2.1. A guy rope 29 is secured on one end via a rope-end fitting or thimble 31 to the top region of the guy support 2.1 and is guided from there in the direction to a point of reversal (not shown), arranged at the boom tip, and back to a deflector sheave 30 disposed in the top area of the guy support 2.1. Form there, the guy rope 29 runs to the winch 27. Positioned on the backside in the top area of the guy support 2.1 is a guy rod 32 for providing a rear safety mechanism for the guy support 2.1.

As described above, the superstructure 15 is swingable so that both guy supports 2.1, 2.2 can be deposited parallel to the topside 3 of the base boom 1 for transport of the telescopic crane. To raise again the guy supports 2.1, 2.2, each of the guy supports 2.1, 2.2 is provided as set-up aid with a piston and cylinder unit 28 (only the piston and cylinder unit 28 of guy support 2.1 is shown here) which has one end hinged to the sidewall 25 and another end hinged to a central region of the pertaining guy support.

Figure 6:
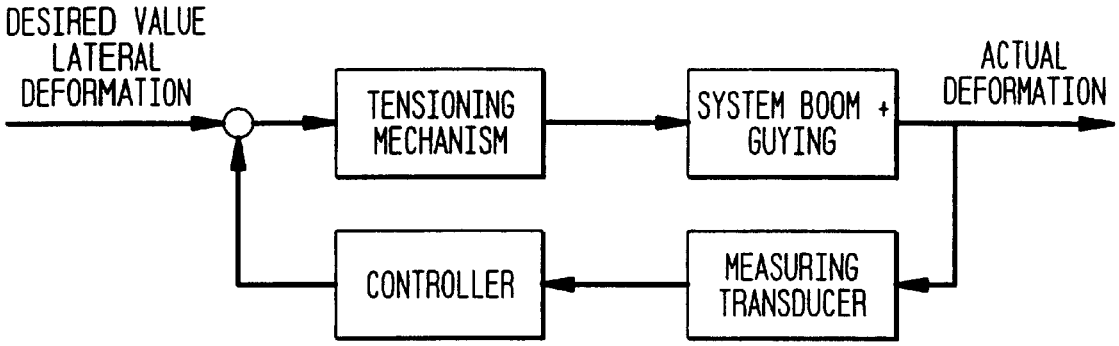
FIG. 6 is a block diagram of a measuring circuit for detecting a lateral deformation of the boom structure of a telescopic crane according to the present invention.

As shown in FIG. 6 the lateral guying is especially effective when providing the crane with a measuring device for detecting a lateral deformation of the boom structure. When the deformation exceeds a predetermined admissible value, the tension member connected to the guying is activated for tautening the guying. The extent of lateral deformation can be registered directly or indirectly by the measuring device via crane parameters, for example, the rope tension, the rope length and the rope extension. However, forces acting upon the boom structure may be used for determination the degree of lateral deformation, such as side winds, exposure to sunlight and temperature of the boom structure.

Figure 7A:
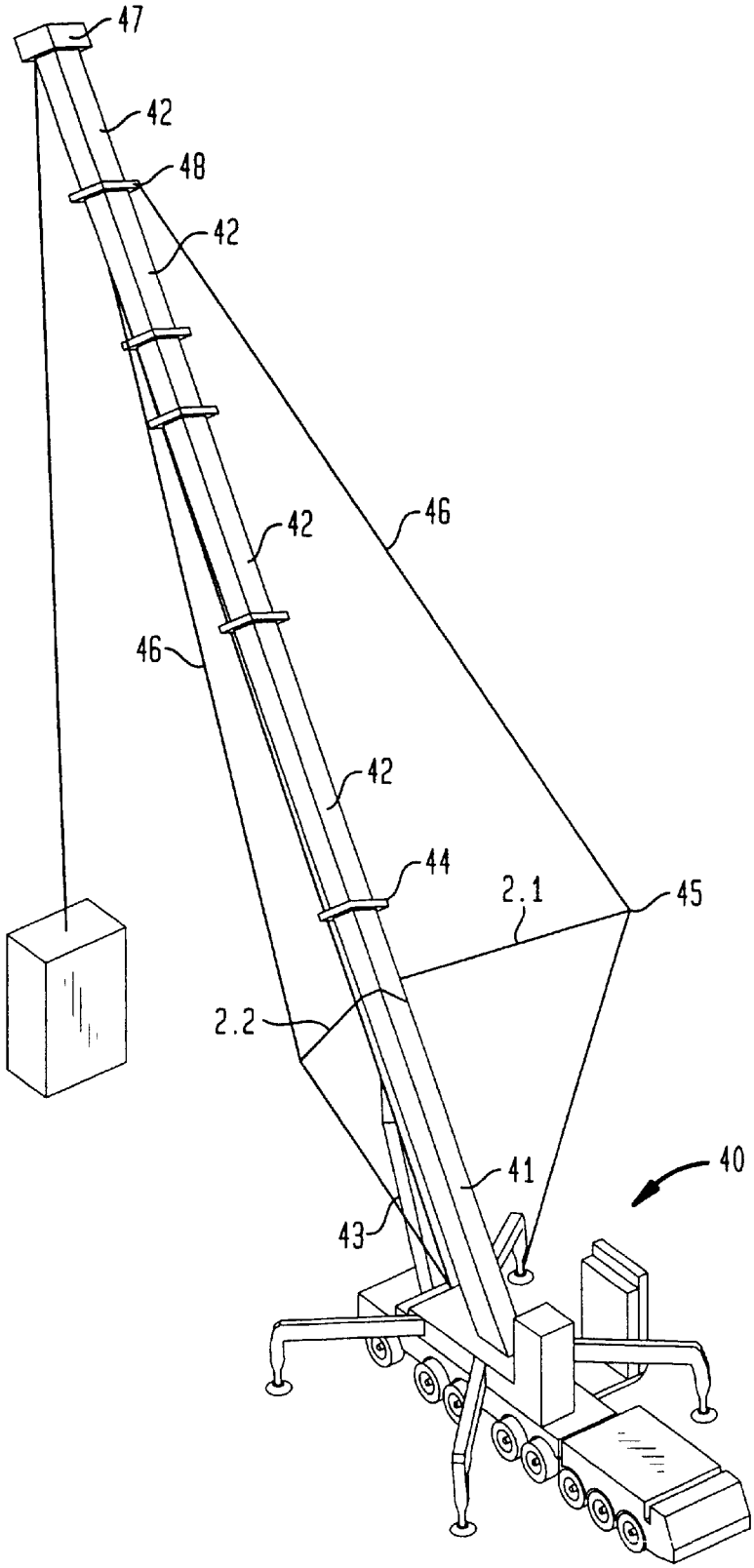
FIGS. 7*a*–7*c* show various exemplified illustrations of telescopic cranes embodying the principles of the present invention.
Figure 7B:
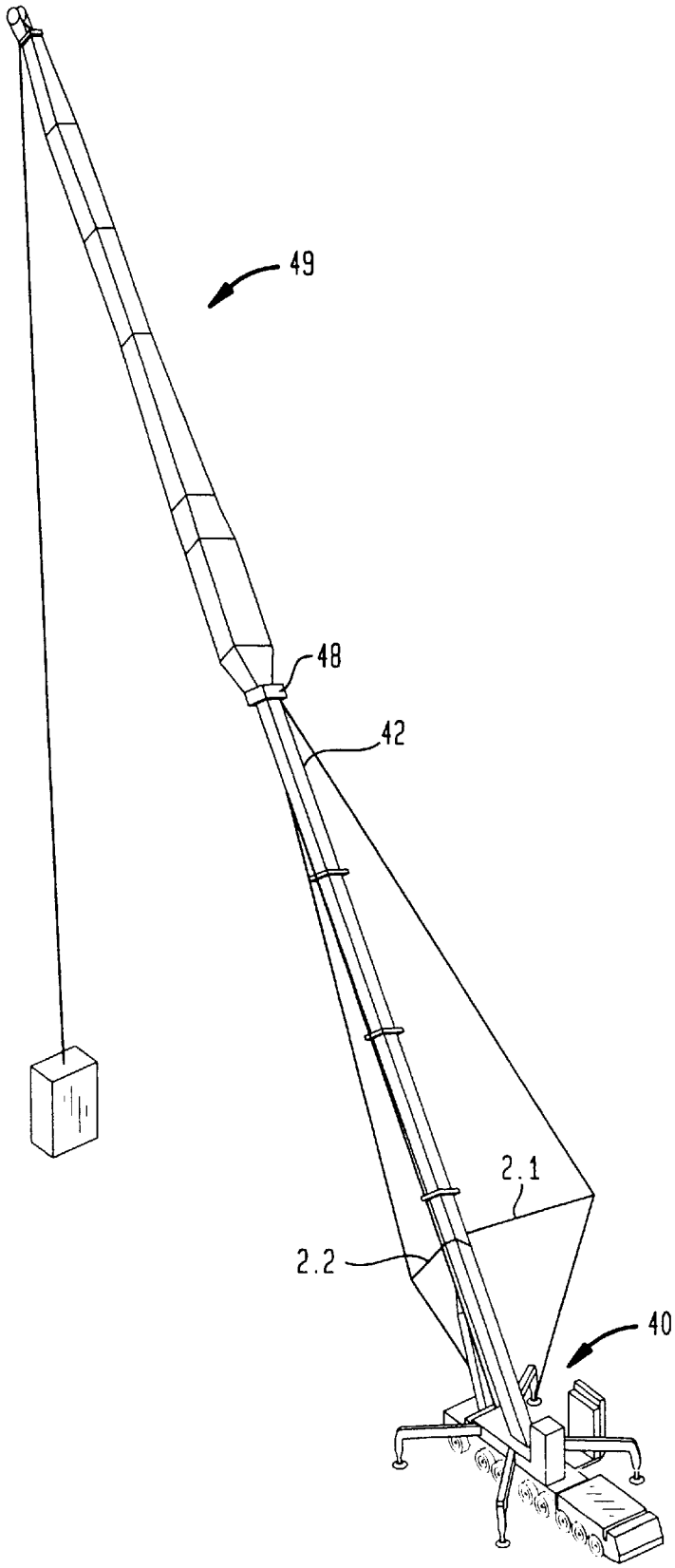
Figure 7C:
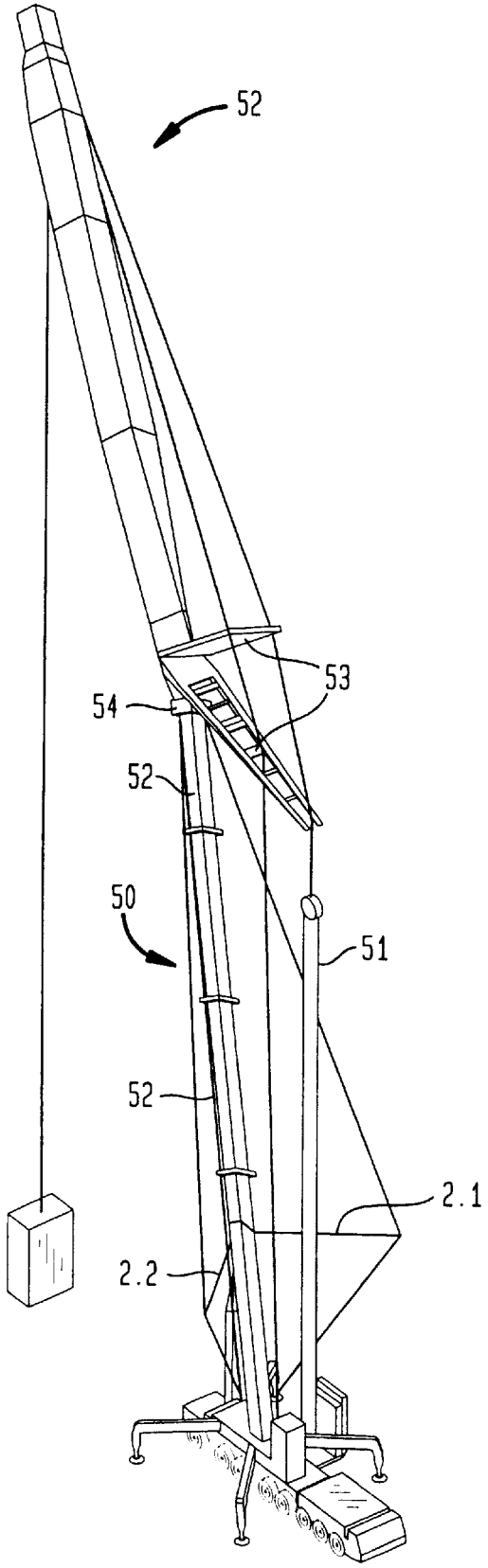

FIGS. 7*a*–7*c* show various exemplified illustrations of telescopic cranes embodying the principles of the present invention. FIG. 7*a* shows a schematic illustration of a mobile telescopic boom crane, generally designated by reference numeral 40 and including a boom base 41 and a plurality of telescope sections 42, with the laterally inclined guy supports 2.1, 2.2 arranged in a forward region between a luffing cylinder 43 and a forward bearing 44 on the boom base 41. The guy supports 2.1, 2.2 have free ends 45 which are connected by boom guy lines 46 in the direction of the boom structure head 47 with the head section or collar 48 of an inner one of the telescope sections 42.

FIG. 7*b* shows a schematic illustration of the telescopic boom crane 40 provided with a rigid fly jib, generally designated by reference numeral 49 to form a tower-like latticed extension of the boom crane 40. The fly jib 49 is mounted to the head 48 of the innermost one of the telescope sections 42.

FIG. 7*c* shows a schematic illustration of a telescopic boom crane, generally designated by reference numeral 50 and including a plurality of telescope sections 52 and a mast 51. The boom crane 50 is extended by a luffing fly jib, generally designated by reference numeral 52 to form a tower-like latticed extension of the boom crane 50. The luffing jib 52 has at least one, suitably two, slewed supports 53 which are mounted to the head 54 of an innermost one of the telescope sections 52.

While the invention has been illustrated and described as embodied in a telescopic crane, it is not intended to be limited to the details shown since various modifications and structural changes may be made without departing in any way from the spirit of the present invention.

What is claimed is:

1. A telescopic crane, comprising a substructure; a superstructure rotatably mounted onto the substructure; a counterweight and a telescoping boom structure including a main boom slewable about a luffing plane and having a boom base and at least one inner telescope section which is received in the boom base and displaceable between retracted and extended positions; and at least one guy mast, mounted to the boom structure, for increasing a load-carrying capability of the crane, said guy mast connected by a first tension means to a foot region of the boom base and by a second tension means to a head section of the inner telescope section, said first and second tension means extending substantially longitudinally in the direction of the boom structure, said guy mast being oriented with respect to the luffing plane at an inclination which is so selected that a lateral load acting on the boom structure is partially or entirely received by the guying.

2. The telescopic crane of claim 1, wherein the boom structure has a topside for attachment of the guy mast.

3. The telescopic crane of claim 1, wherein the guy mast is oriented in a plane extending centrally in longitudinal direction of the boom structure and a load, said guy mast destined for inclination at an angle $\alpha>0$ defined transversely to a longitudinal axis of the boom structure.

4. The telescopic crane of claim 1, wherein the guy mast is oriented in a plane extending centrally in longitudinal direction of the boom structure and a load, said guy mast destined for inclination at an angle $\beta>0$ defined by a vertical drawn upon the boom structure.

5. The telescopic crane of claim 1, wherein the guy mast is oriented in a plane extending centrally in longitudinal direction of the boom structure and a load, said guy mast destined for superimposed inclination in a direction at an angle which is defined transversely to a longitudinal axis of the boom structure and greater than zero and at an angle which is defined by a vertical drawn upon the boom structure and greater than zero.

6. The telescopic crane of claim 1, wherein the boom structure has a topside for attachment of two of said guy mast.

7. The telescopic crane of claim 6, wherein the guy masts are positioned at a selected location on the topside, with one of the guy masts extending to one side on the topside, and with the other one of the guy masts extending to an opposite side on the topside.

8. The telescopic crane of claim 7, wherein each of the guy masts has a foot end, said foot end of one guy mast and said foot end of the other guy mast connected at a common area with the topside of the boom structure.

9. The telescopic crane of claim 7, wherein each of the guy masts has a foot end, said foot end of one guy mast and said foot end of the other guy mast connected offset to one another on the topside of the boom structure.

10. The telescopic crane of claim 7, wherein each of the guy masts has a foot end, said foot end of at least one of the guy masts being connected with the boom structure at a transition area between the topside and a sidewall of the boom structure.

11. The telescopic crane of claim 7, and further comprising a girder extending transversely to the longitudinal axis of the boom structure and projecting beyond the boom structure, each of the guy masts having a foot end, wherein the foot end of at least one of the guy masts is arranged on the girder.

12. The telescopic crane of claim 1, wherein the guy mast has a free end, said tension means including a first tension member and a second tension member, said free end of the guy mast connected by the first tension member to a member selected from the group consisting of the superstructure, substructure, a foot region of the boom structure, the counterweight guided fixedly or separately, and a bottom in direction of a foot end of the boom structure, and connected by the second tension member to a member selected from the group consisting of a selected area of the main boom and a portion of an extension of the boom structure in the direction of the free end of the boom structure.

13. The telescopic crane of claim 1, wherein a selected angular inclination is adjustable by swinging the guy mast step-by-step or continuously.

14. The telescopic crane of claim 1, wherein the guy mast has a length which is adjustable step-by-step or continuously.

15. The telescopic crane of claim 1, wherein the tension means includes a guy rope or a guy rod.

16. The telescopic crane of claim 1, and further comprising a tension mechanism for cooperation with the tension means.

17. The telescopic crane of claim 16, wherein the tension mechanism is realized through at least one of angular adjustment and change in length of the guy mast.

18. The telescopic crane of claim 16, wherein the tension mechanism is one of a winch and a piston and cylinder unit.

19. The telescopic crane of claim 16, wherein the tension mechanism is selectively mounted to one of the superstructure, substructure, main boom, counterweight and boom structure elongation.

20. The telescopic crane of claim 1, wherein for guying, at least two separately operable tension mechanisms are provided.

21. The telescopic crane of claim 1, wherein two of said guy mast are arranged at the main boom in the area of the boom base.

22. The telescopic crane of claim 21, wherein the guy masts are arranged in a forward region between a luffing cylinder and a forward bearing on the boom base.

23. The telescopic crane of claim 21, wherein the guy masts have free ends which are connected with the head section or collar of an inner one of telescope sections.

24. The telescopic crane of claim 1, and further comprising a piston and cylinder unit supported by the boom base, said guy mast being operatively connected with the piston and cylinder unit for implementing a lateral inclination of the guy mast.

25. The telescopic crane of claim 1, wherein the guy mast includes two poles in approximate parallel disposition.

26. The telescopic crane of claim 25, and further comprising a winch positioned between the poles of the guy mast.

27. The telescopic crane of claim 1, and further comprising a rigid fly jib made in the form of a latticed tower and mounted to a head section of the inner telescope section.

28. The telescopic crane of claim 1, and further comprising a luffing fly jib made in the form of a lattice tower with at least one slewed and mounted to a head of an innermost one of the telescope sections.

29. The telescopic crane of claim 1, and further comprising a measuring means for determining a lateral deformation of the boom structure, said measuring means being operatively linked with a tensioning mechanism by which the tautening degree of the lateral guying is influenced.

30. The telescopic crane of claim 29, wherein the lateral deformation is determined, directly or indirectly, via crane parameters, including rope tension, rope length, rope extension, forces acting on the boom structure, exposure to side winds, exposure to sunlight, and temperatures of the main boom.

* * * * *